US009123313B2

(12) United States Patent
Hyams

(10) Patent No.: US 9,123,313 B2
(45) Date of Patent: Sep. 1, 2015

(54) APPARATUS FOR PREVENTING A FOOT PEDAL ASSEMBLY FROM MOVING AWAY FROM A SEAT AND METHOD OF USE

(71) Applicant: Robert Norman Hyams, McCoy, CO (US)

(72) Inventor: Robert Norman Hyams, McCoy, CO (US)

( * ) Notice: Subject to any disclaimer, the term of this patent is extended or adjusted under 35 U.S.C. 154(b) by 503 days.

(21) Appl. No.: 13/624,204

(22) Filed: Sep. 21, 2012

(65) Prior Publication Data

US 2013/0086790 A1 Apr. 11, 2013

Related U.S. Application Data

(60) Provisional application No. 61/627,181, filed on Oct. 6, 2011.

(51) Int. Cl.
*G10D 13/00* (2006.01)

(52) U.S. Cl.
CPC ..... *G10D 13/00* (2013.01); *Y10T 24/27* (2015.01); *Y10T 29/49826* (2015.01)

(58) Field of Classification Search
CPC ..... G10D 13/026; G10D 13/00; G10H 2230/291; G10G 5/005
USPC ..... 84/422.1, 422.2, 422.3
See application file for complete search history.

(56) References Cited

U.S. PATENT DOCUMENTS

| | | | | |
|---|---|---|---|---|
| 4,441,398 | A | 4/1984 | Baker | |
| 6,967,272 | B2 | 11/2005 | Green | |
| 8,642,870 | B1 * | 2/2014 | Rosa | 84/453 |
| 2005/0156090 | A1 | 7/2005 | Drayton, Jr. | |

FOREIGN PATENT DOCUMENTS

DE 010029627 A1 * 3/2001 ..... A44B 18/0073

OTHER PUBLICATIONS http://www.blackwidowdrumweb.com/ Canadian Musician Date: Jul. 1, 2012 Norris-Whitney Communications Jul.-Aug. 2012, vol. 34 Issue 4, p. 72, 1 p.*

* cited by examiner

*Primary Examiner* — Kimberly Lockett
(74) *Attorney, Agent, or Firm* — Ted Masters

(57) ABSTRACT

Apparatus for preventing a foot pedal assembly from moving away from a seat includes a mat having a top surface and an opposite bottom surface. The mat is shaped and dimensioned to receive the foot pedal assembly and to receive the seat. One of hook and loop material is disposed on the top surface of the mat, the one of hook and loop material positioned, shaped, and dimensioned to removably connect to the foot pedal assembly. The other of hook and loop material is disposable on the bottom surface of the foot pedal assembly, so that the foot pedal assembly can be removably connected to the mat.

11 Claims, 9 Drawing Sheets

APPARATUS FOR PREVENTING A FOOT PEDAL ASSEMBLY FROM MOVING AWAY FROM A SEAT AND METHOD OF USE

CROSS REFERENCE TO RELATED APPLICATION

This application claims the filing benefit under 35 U.S.C. §119(e) of U.S. Provisional Application No. 61/627,181, filed Oct. 6, 2011, which is hereby incorporated by reference.

TECHNICAL FIELD

The present invention pertains generally to devices which are activated with a foot pedal (such as some musical instruments), and more particularly to an apparatus for keeping the foot pedal from moving as a result of the activation.

BACKGROUND OF THE INVENTION

As is well known in the musical art, some musical instruments are activated by foot pedals (drums, cymbals, etc.), and as such have a tendency to slide away from the user as they are played. This movement is called "creep" and is caused by the continuous use of the instrument's foot pedal. As the foot pedal is repeatedly depressed, the pedal and instrument to which it is attached move outwardly away from the user who is seated upon a seat (throne). The outward movement is caused by the pressure applied to the foot pedal as well as vibration of the musical instrument. Placing a rug or carpet under the musical instrument and foot pedal can reduce but not eliminate the creep.

BRIEF SUMMARY OF THE INVENTION

The present invention is directed to an apparatus for restraining the foot pedal of a musical instrument such as a drum. The apparatus is lightweight, easily transportable (fits into a small bag), is very robust, is adaptable to the individual player, and fits virtually 100% of all the drum gear in the world. The present invention can be used with drums or other musical instruments, like keyboard volume pedals, cymbals, etc, or can be used with industrial equipment such as a sewing machine foot pedal. The present invention can also be used in the electronic video game industry (e.g, rock band and guitar hero type games) These gaming drum sets and accessories are very light weight and therefore prone to creep.

In an embodiment, apparatus for preventing a foot pedal assembly from moving away from a seat includes a mat which has a top surface and an opposite bottom surface. The mat is shaped and dimensioned to receive the foot pedal assembly and to receive the seat. One of hook and loop material is disposed on the top surface of the mat, the one of hook and loop material positioned, shaped, and dimensioned to removably connect to the foot pedal assembly.

In accordance with another embodiment, the foot pedal assembly has a bottom surface. The other of hook and loop material is disposable on the bottom surface of the foot pedal assembly.

In accordance with another embodiment, the other of hook and loop material includes an adhesive for connection to the bottom surface of the foot pedal assembly.

In accordance with another embodiment, the mat includes a seat area in which the seat is positionable, the seat area having a center. The one of hook and loop material includes a strip, the strip oriented substantially perpendicular to a radial line which outwardly emanates from the center.

In accordance with another embodiment, a plurality of strips are spaced apart along the radial line, the plurality of strips combining to form a strip sector.

In accordance with another embodiment, the foot pedal assembly has a center line and a bottom surface, the bottom surface includes a toe portion which is spaced apart a distance from a heel portion. The plurality of strips includes a far strip and a near strip. The far strip is spaced apart from the near strip by a strip distance such that when the foot pedal assembly is placed upon the mat with the center line oriented along the radial line, the toe portion of the foot pedal assembly will abut the far strip and the heel portion of the foot pedal assembly will abut the near strip.

In accordance with another embodiment, the plurality of strips includes a middle strip which is disposed between the far strip and the near strip.

In accordance with another embodiment, a plurality of strip sectors reside in abutting side-by-side relationship.

In accordance with another embodiment, the seat includes a plurality of legs each leg having a foot. At least one foot anchor station is disposed on the top surface of the mat, the foot anchor station including one of hook and loop material. At least one foot anchor is provided, the foot anchor is shaped and dimensioned to receive one foot of the seat. The foot anchor includes the other of hook and loop material so that the foot anchor can be removably connected to the foot anchor station, so that the foot can be positioned in the foot anchor for the purpose of restraining the seat.

Other embodiments, in addition to the embodiments enumerated above, will become apparent from the following detailed description, taken in conjunction with the accompanying drawings, which illustrate, by way of example, the principles of the apparatus and method of use.

DETAILED DESCRIPTION OF THE INVENTION

Figure 1:
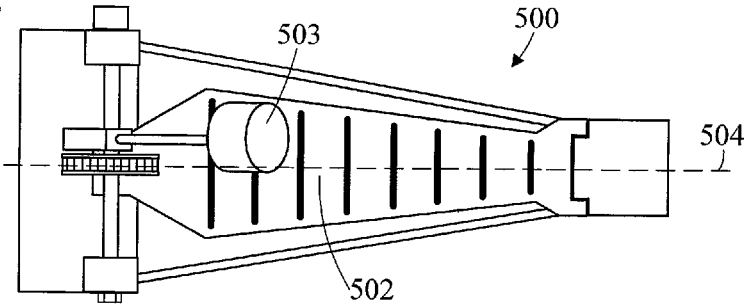
Fig. 1 PRIOR ART
FIG. 1 is an enlarged top plan view of a prior art foot pedal assembly.
Figure 2:
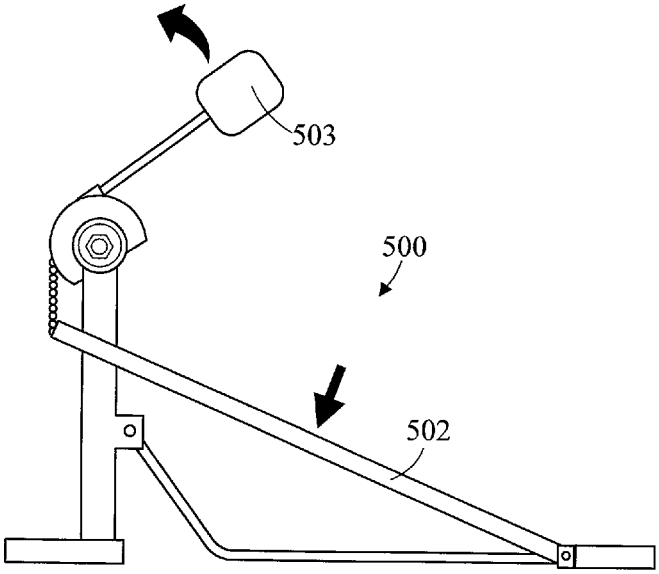
Fig. 2 PRIOR ART
FIG. 2 is a side elevation view of the foot pedal assembly.
Figure 3:
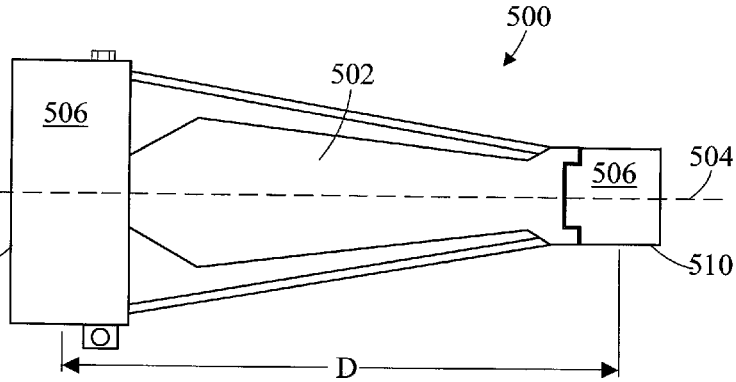
Fig. 3 PRIOR ART
FIG. 3 is a bottom plan view of the foot pedal assembly.

Referring initially to FIGS. 1-3, there are illustrated top plan, side elevation, and bottom plan views respectively of a prior art foot pedal assembly for a drum set, the foot pedal assembly generally designated as 500. In the shown embodiment, foot pedal assembly 500 is for a drum, however foot pedal assembly can also be adapted for use with cymbals or other devices (refer to FIG. 4). When the foot plate 502 of foot pedal assembly 500 is depressed by the user it activates the instrument to which it is attached. In the shown embodiment, depressing foot plate 502 causes beater 503 to strike drum 700 (refer to FIG. 4). Foot pedal assembly 500 has a center line 504 and a bottom surface 506, bottom surface 506 includes a toe portion 508 which is spaced apart a distance D from a heel portion 510. Also in the shown embodiment, foot pedal assembly 500 is a breakdown assembly which collapses, but could also be of the solid type. To prevent unwanted movement, foot pedal assembly 500 is typically physically connected to the instrument which it activates (drum, cymbal, etc.).

Figure 4:
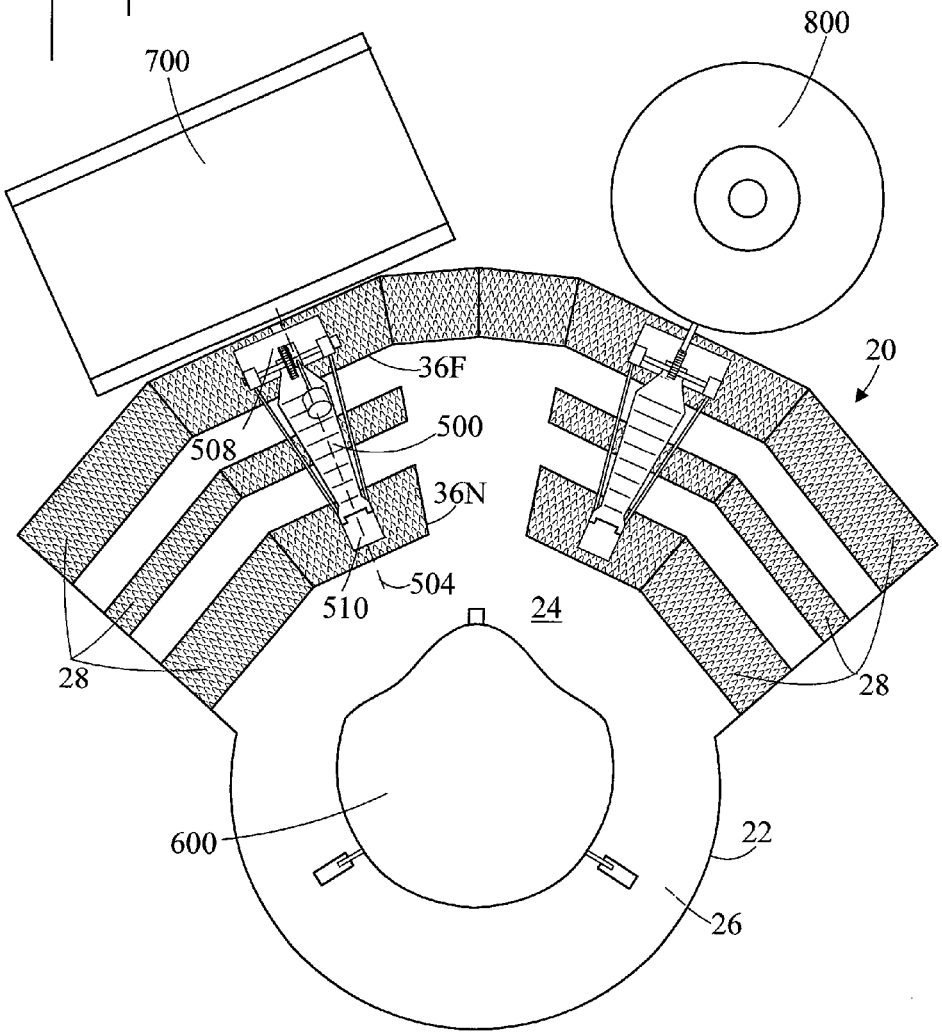
FIG. 4 is a top plan view of a drum set which includes a seat for the drummer, a drum and cymbals, associated foot pedal assemblies, and an apparatus for preventing the foot pedal assembly from moving away from the seat when the drum and cymbals are played.

Now referring to FIG. 4, there is illustrated a top plan view of a drum set which includes a seat 600 for the drummer, a drum 700, cymbals 800, associated foot pedal assemblies 500, and an apparatus for preventing the foot pedal assembly 500 from moving away from seat 600 when drum 700 and cymbals 800 are played, the apparatus generally designated as 20. In the shown embodiment seat 600 is drum stool or throne, but could be another type of seat. Apparatus 20 includes a mat 22 which has a top surface 24 and an opposite bottom surface 26. As used herein the term "mat" includes any covering made of thin material which can be spread out upon a horizontal support surface such as a floor. In an embodiment, mat 22 is made from 600 denier nylon fabric. Mat 22 is shaped and dimensioned to receive foot pedal assembly 500 and to receive the seat 600. That is, foot pedal assembly 500 and seat 600 can be placed on top surface 24 of mat 22. One of hook and loop material 28 (shown shaded) is fixedly disposed on top surface 24 of mat 22, and is positioned, shaped, and dimensioned to removably connect to foot pedal assembly 500. The drummer (user) sits on seat 600, and the weight of seat 600 and the drummer keep apparatus 20 from moving.

Drum 700 is connected to a foot pedal assembly 500, which when depressed activates the drum 700. Similarly a foot pedal assembly 500 is connected to cymbals 800. It is noted that the novel multi-position circular arrangement of hook-and-loop material 28 allows foot pedal assemblies 500 to be arranged in a desired relative position with respect to seat 600. Further, it may be appreciated that the drum-related embodiment discussed herein is only one possible application of apparatus 20. The apparatus and method described below can also be applied to other devices, musical or not, which employ foot pedals as an activation mechanism.

Figure 5:
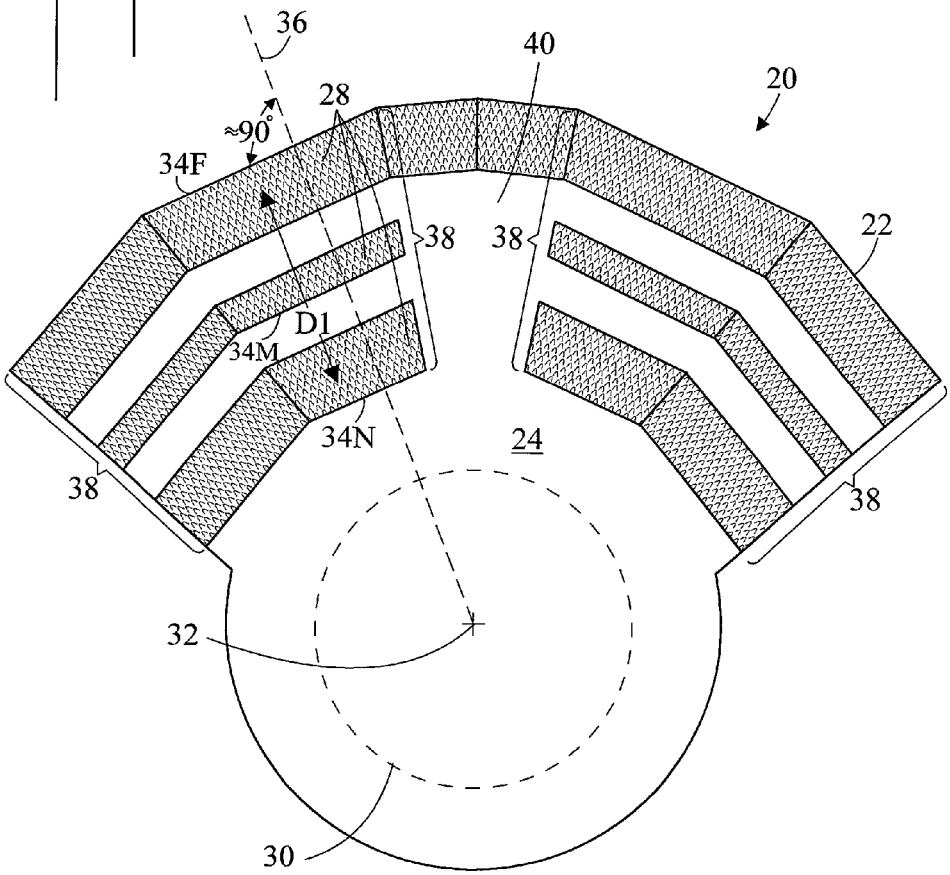
FIG. 5 is a top plan view of the apparatus.
Figure 15:
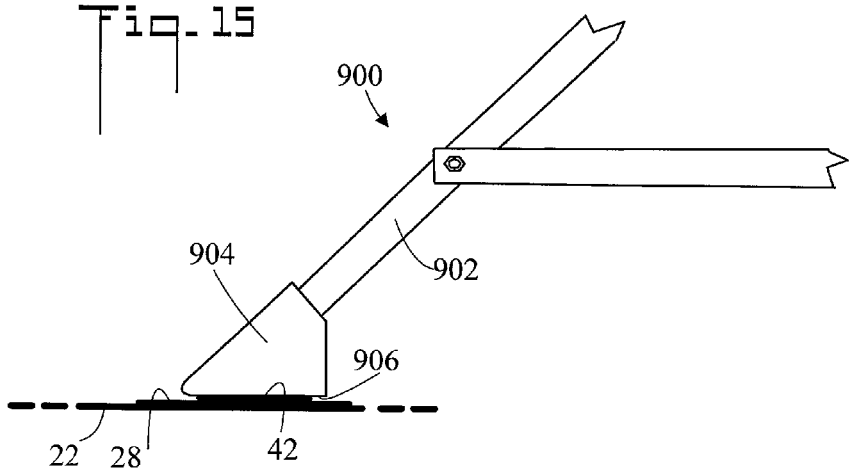
FIG. 15 is an enlarged fragmented side elevation view of a musical instrument stand having a leg and a foot.

FIG. 5 is a top plan view of apparatus 20. Mat 22 includes a seat area 30 in which seat 600 (refer to FIG. 4) is positionable, seat area 30 having a center 32. One of hook and loop material 28 includes a strip 34 which is oriented substantially perpendicular to a radial line 36 which outwardly emanates from center 32. In the shown embodiment, a plurality of strips 34 are spaced apart along radial line 36 wherein each strip 34 is substantially perpendicular to radial line 36, the plurality of strips including a far strip 34F (furthest from center 32), a near strip 34N (closest to center 32), and a middle strip 34M which is disposed between far strip 34F and near strip 34N. The three strips 34F, 34N, and 34M combine to form a strip sector 38 (in the shape of a truncated wedge). Far strip 34F is spaced apart from near strip 34N by a strip distance D1 such that when foot pedal assembly 500 is placed upon mat 22 with center line 504 oriented along radial line 34, toe portion 508 of foot pedal assembly 500 will abut far strip 34F and heel portion 510 of foot pedal assembly 500 will abut near strip 34N (also refer to FIGS. 1-3, and 4). It is further noted that in the shown embodiment, a plurality of strip sectors 38 reside in abutting side-by-side relationship. In the shown embodiment four sectors 38 are disposed on the surface of mat 22 forming two sector pairs. It may be appreciated however than another number of sectors could be used (refer to FIG. 15.

It is noted that in the shown embodiment, the strips 34F, 34N, and 34M are straight strips of one of hook and loop material 28 which in effect define an arc with respect to center 32. However, it may be appreciated that the strips could also be a curved arc rather than straight.

Also in the shown embodiment, one of hook and loop material 28 is loop material. Loop material is preferable since it will not scratch or captively engage other articles with which it comes in contact. Also in the shown embodiment, an open area 40 is provided to accommodate instruments which do not utilize a foot pedal.

In another embodiment, the bottom surface 26 of mat 22 can include friction enhancing material such as rubber to minimize sliding on a smooth support surface. And in yet another embodiment, the entire or a portion of the bottom surface 24 of mat 22 can be covered with hook material so that it will grip a carpet support surface.

Figure 6:
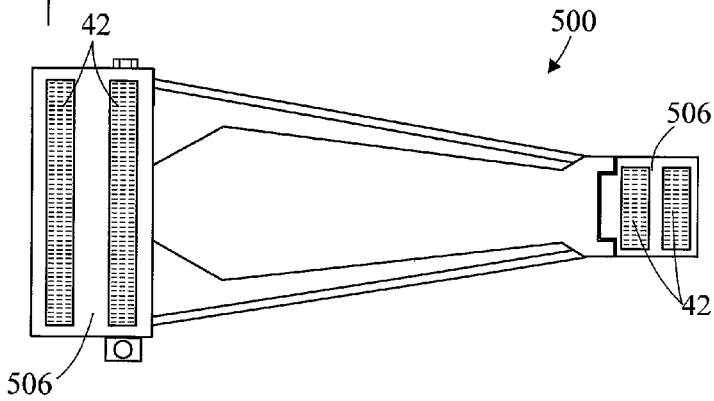
FIG. 6 is an enlarged bottom plan view of the foot pedal assembly with hook and loop material connected to the bottom surface of the foot pedal assembly.
Figure 7:
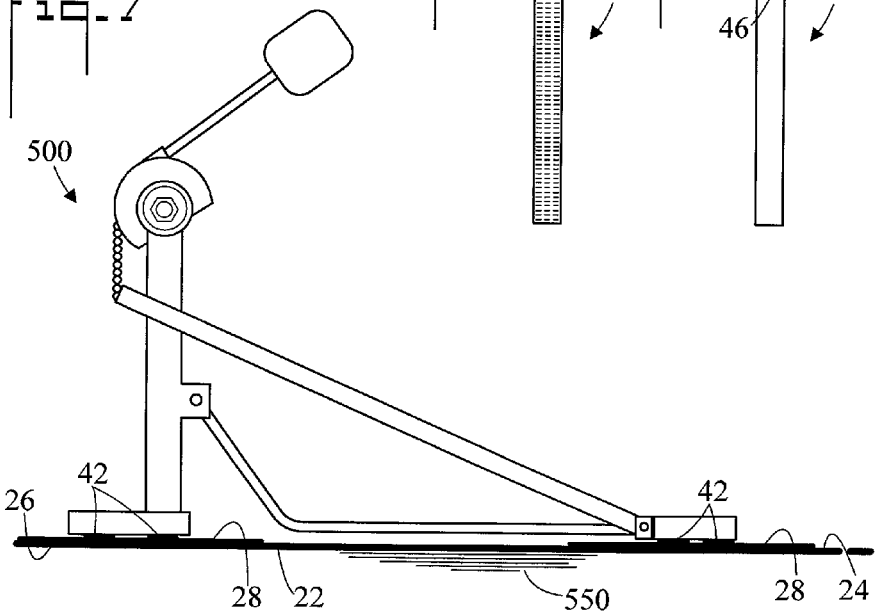
FIG. 7 is an enlarged side elevation view of the foot pedal assembly connected to a mat.

FIG. 6 is an enlarged bottom plan view of foot pedal assembly 500 with hook and loop material connected to its bottom surface 506, and FIG. 7 is an enlarged side elevation view of foot pedal assembly connected 500 to mat 22, and mat 22 being disposed on a support surface 550 such as a floor. The other of hook and loop material 42 is disposable on bottom surface 506 of foot pedal assembly 500. The other of hook and loop material 42 connects to the one of hook and loop material 28 which is disposed on the top surface 24 of mat 22. In the shown embodiment the other of hook and loop material 42 disposed on the bottom surface 506 of foot pedal assembly 500 is hook material which connects to the loop material 28 disposed on mat 22, thereby removably connecting foot pedal assembly 500 to mat 22 so that foot pedal assembly 500 will not move when used. Because of the cooperating hook and loop material, foot pedal 500 can be selectively connected to a desired location on apparatus 20 (refer to FIG. 4).

Figure 8:
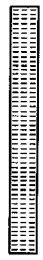
FIG. 8 is an enlarged bottom plan view of the hook and loop material of FIG. 6.
Figure 9:
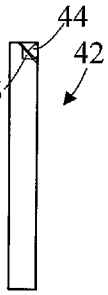
FIG. 9 is an enlarged top plan view of the hook and loop material of FIG. 7.

FIGS. 8 and 9 are enlarged bottom plan and top plan views respectively of the other of hook and loop material 42 of FIG. 6. In FIG. 9, it is noted that the other of hook and loop material 42 includes an adhesive 44 for connection to the bottom surface 506 of foot pedal assembly 500 (refer to FIG. 6). Adhesive 44 is covered with release paper 46.

Figure 10:
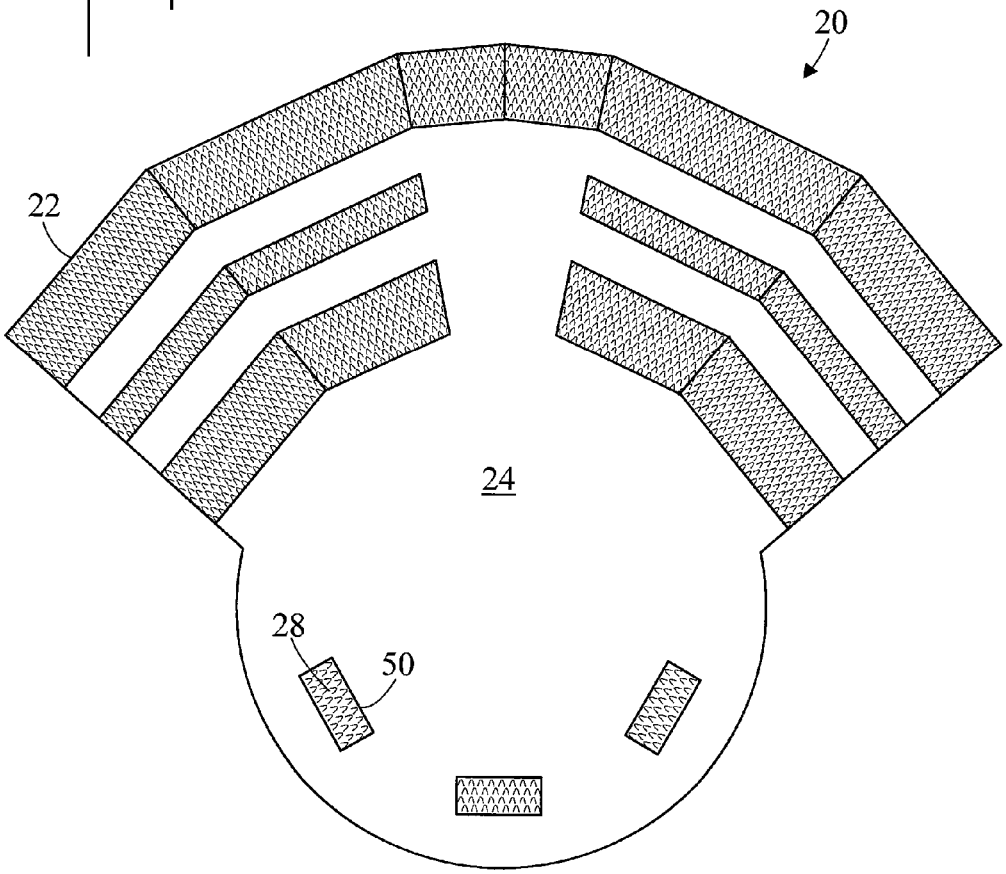
FIG. 10 is a top plan view of another embodiment of the apparatus.

FIG. 10 is a top plan view of another embodiment of apparatus 20. At least one foot anchor station 50 (three in the shown embodiment) is disposed on top surface 24 of mat 22, foot anchor station 50 includes one of hook and loop material 28.

Figure 11:
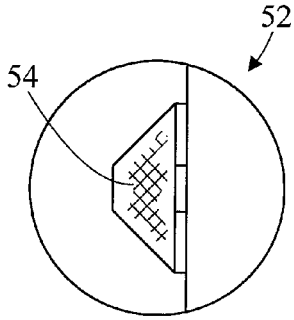
FIG. 11 is an enlarged top plan view of a foot anchor.
Figure 12:
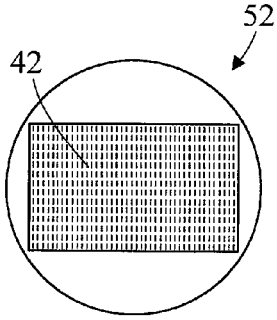
FIG. 12 is an enlarged bottom plan view of the foot anchor.

FIGS. 11 and 12 are enlarged top plan and bottom plan views respectively of a foot anchor 52. Foot anchor 52 is shaped and dimensioned to receive one foot 604 of seat 600 (refer to FIG. 13), and foot anchor 52 includes the other of hook and loop material 42 disposed on its bottom surface so that foot anchor 52 can be removably connected to foot anchor station 50 (refer to FIGS. 10, 13, and 14). A restraining strap 54 (such as made from a fabric) on foot anchor 52 receives foot 604 of seat 600. It may be appreciated however that other structures for receiving and restraining foot 604 could also be utilized.

Figure 13:
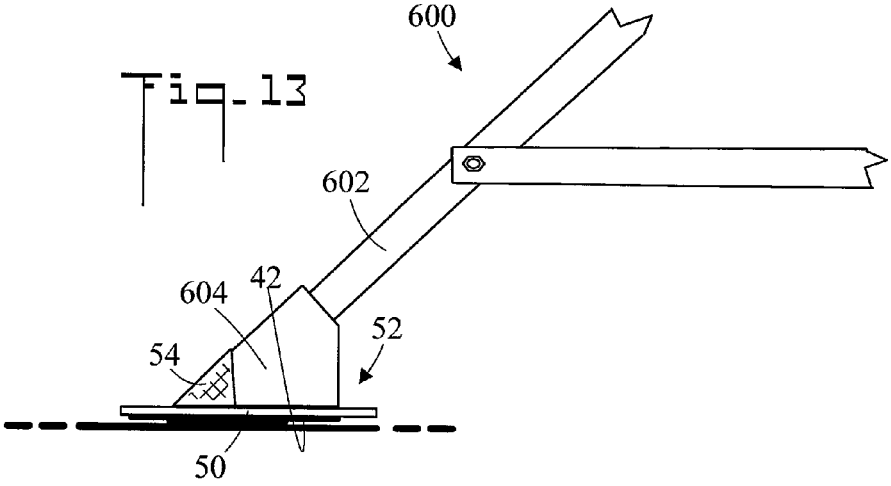
FIG. 13 is an enlarged fragmented side elevation view of the foot anchor receiving the foot of the seat.

FIG. 13 is an enlarged fragmented side elevation view of foot anchor 52 receiving foot 604 of seat 600. Seat 600 includes a plurality of legs 602 each leg 602 having a foot 604. Foot 604 is positioned in foot anchor 52 for the purpose of keeping mat 22 from moving. The other of hook and loop material 42 on foot anchor 52 engages the one of hook and loop material 28 of foot anchor station 50 (refer also to FIG. 14). As such, foot 604 is connected to foot anchor 52 which is connected to foot anchor station 50, thereby holding mat 22 in place under seat 600.

Figure 14:
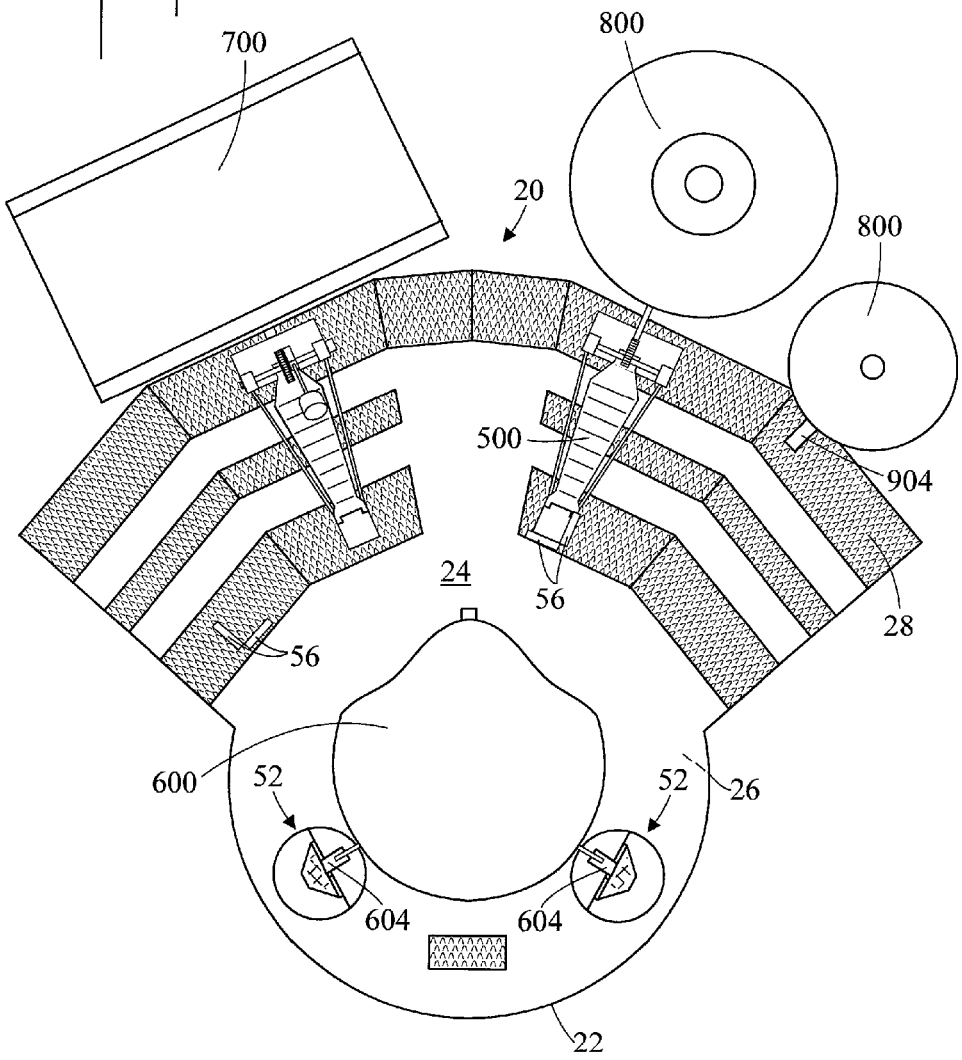
FIG. 14 is a top plan view of the apparatus and a drum set showing the feet of the seat received by the foot anchors.

FIG. 14 is a top plan view of apparatus 20 the drum set showing two feet 604 of seat 600 received by foot anchors 52. As such, seat 600 is prevented from moving away from drums 700 and cymbals 800. Also shown in FIG. 14 are marking strips 56 which can be removably connected to the one of hook and loop material 28 of strips 34 and left in place for the purpose of marking a desired future placement of a foot pedal assembly 500.

FIG. 14 also illustrates another use of apparatus 20, for preventing a musical instrument from moving when used. Also referring to FIG. 15, the musical instrument includes a stand 900 which has a leg 902 and a foot 904 having a bottom surface 906. Mat 22 has a top surface 24 and an opposite bottom surface 26, mat 22 is shaped and dimensioned to receive foot 904 of stand 900. One of hook and loop material 28 is fixedly disposed on top surface 24 of mat 22, the one of hook and loop material 28 positioned, shaped, and dimensioned to removably connect to foot 904 of stand 900. The other of hook and loop material 42 is disposable on bottom surface 906 of foot 904. As with the embodiment of FIGS. 8 and 9, the other of hook and loop material 42 includes an adhesive for connection to the bottom surface 906 of foot 904.

Figure 16:
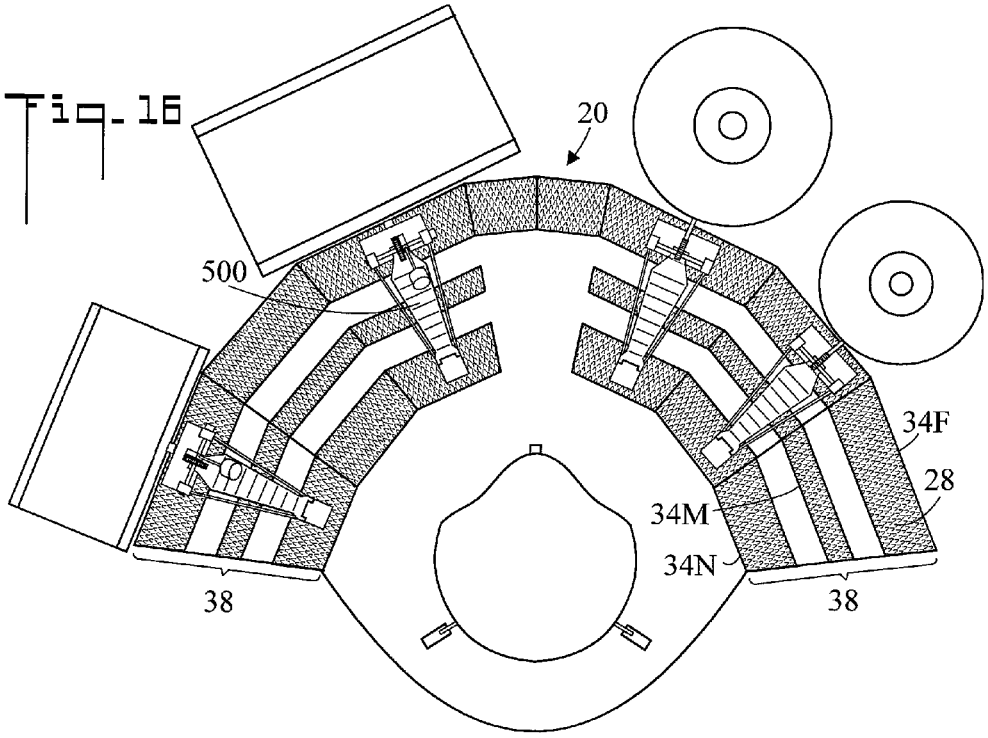
FIG. 16 is a reduced top plan view of another embodiment of the apparatus having additional strip sectors; and, FIG. 17 is a top plan view showing another use for the apparatus.

FIG. 16 is a reduced top plan view of another embodiment of apparatus 20 which has additional strip sectors 38. Strip sectors 38 have been added to the two sides of the apparatus 20 shown in FIGS. 4, 5, 10, and 14, thereby increasing the number of sectors from four to six, and allowing more foot pedal assemblies 500 to be installed. It may be appreciated that the number of sectors 38 can be increased or decreased in order to provided an apparatus 20 which is of sufficient size to accommodate a desired number of foot pedals 500. Also it may be appreciated that the far strip 34F, the middle strip 34M, and the near strip 34N could be combined to form one large strip 36. That is, the spaces between strips 36 could be filled with one of hook and loop material 28.

Figure 17:
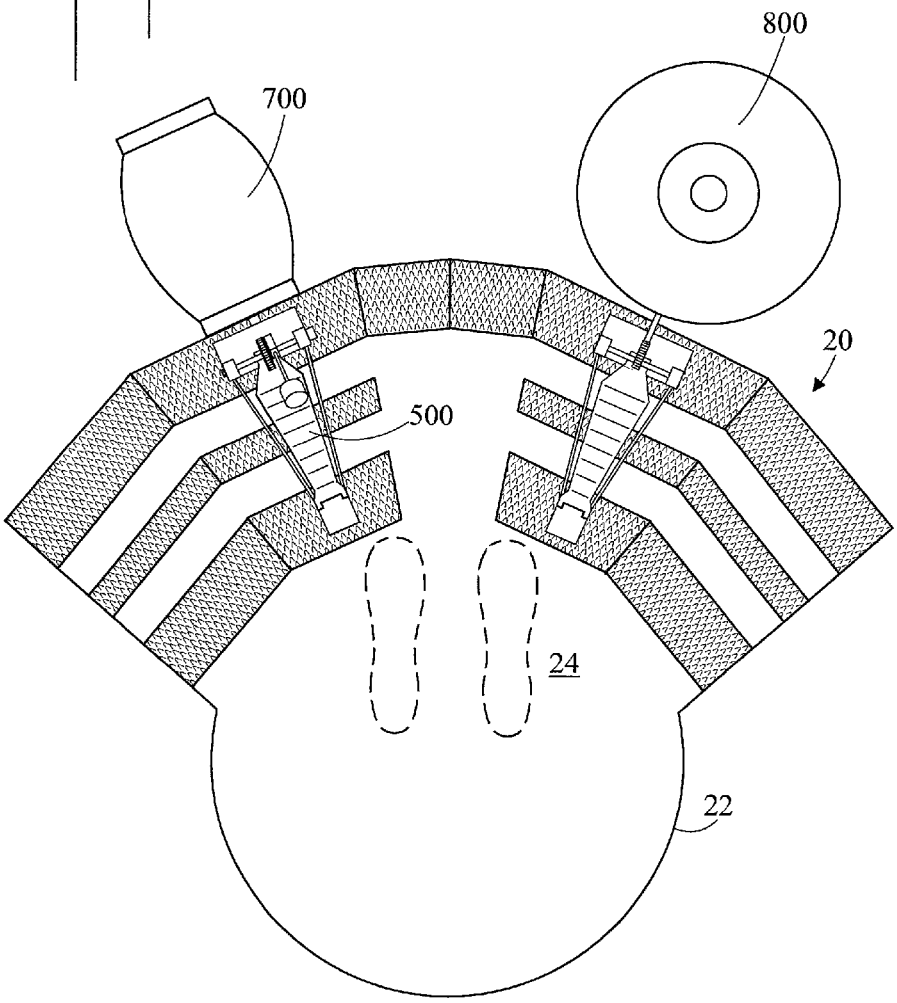

FIG. 17 is a top plan view showing another use for apparatus 20. In this embodiment, mat 22 is used by a percussion instrument player who stands rather than sits on mat 22 (as indicated by the outlined feet). The percussion player can use a foot pedal assembly 500 to activate percussion instruments such as drums, cymbals, bells, and the like.

In terms of use, a method for preventing a foot pedal assembly 500 from moving away from a seat 600 includes: (refer to FIGS. 1-16)

(a) providing a foot pedal assembly 500 having a bottom surface 506;

(b) providing a seat 600;

(c) providing apparatus 20 for preventing foot pedal assembly 500 from moving away from seat 600, including:

a mat 22 having a top surface 24 and an opposite bottom surface 26, mat 22 shaped and dimensioned to receive foot pedal assembly 500 and to receive seat 600;

one of hook and loop material 28 fixedly disposed on top surface 24 of mat 22, the one of hook and loop material 28 positioned, shaped, and dimensioned to removably connect to foot pedal assembly 500;

mat 22 including a seat area 30 in which seat 600 is positionable, seat area 30 having a center 32;

the one of hook and loop material 28 including a strip 34, strip 34 oriented substantially perpendicular to a radial line 36 which outwardly emanates from center 32;

(d) placing seat 600 upon mat 22 so that seat 600 resides in seat area 30;

(e) providing the other of hook and loop material 42;

(f) connecting the other of hook and loop material 42 to the bottom surface of foot pedal assembly 500; and, (g) placing foot pedal assembly 500 on strip 34, so that foot pedal assembly 500 is connected to mat 22.

The method further including:

in (a), foot pedal assembly 500 having a center line 504 and a bottom surface 506 including a toe portion 508 which is spaced apart a distance D from a heel portion 510; and, in (c) providing a plurality of strips 34 spaced apart along radial line 36, the plurality of strips 34 combining to form a strip sector 38, the plurality of strips 34 including a far strip 34F and a near strip 34N, far strip 34F spaced apart from near strip 34N by a strip distance D1 such that in (g) when foot pedal assembly 500 is placed upon mat 22 with center line 504 oriented along radial line 36, toe portion 508 of foot pedal assembly 500 will abut far strip 34F and heel portion 510 of foot pedal assembly 500 will abut near strip 34N.

The method further including:

in (b), seat 600 including a plurality of legs 602 each leg having a foot 604;

in (c), providing at least one foot anchor station 50 disposed on top surface 24 of mat 22, foot anchor station 50 including one of hook and loop material 28;

in (c), providing at least one foot anchor 52 which is shaped and dimensioned to receive one foot 604 of seat 600, foot anchor 50 including the other of hook and loop material 42 so that foot anchor 50 can be removably connected to foot anchor station 50;

connecting foot anchor 52 to foot anchor station 50; and, positioning foot 604 in foot anchor 52 for the purpose of keeping mat 22 from moving.

The embodiments of the apparatus and method of use described herein are exemplary and numerous modifications, combinations, variations, and rearrangements can be readily envisioned to achieve an equivalent result, all of which are intended to be embraced within the scope of the appended claims. Further, nothing in the above-provided discussions of the apparatus and method should be construed as limiting the invention to a particular embodiment or combination of embodiments. The scope of the invention is defined by the appended claims.

I claim:

1. Apparatus for preventing a foot pedal assembly from moving away from a seat, the foot pedal assembly having a bottom surface, the apparatus comprising:

a mat having a top surface and an opposite bottom surface, said mat shaped and dimensioned to receive the foot pedal assembly and to receive the seat;

one of hook and loop material disposed on said top surface of said mat, said one of hook and loop material positioned, shaped, and dimensioned to removably connect to the foot pedal assembly;

the other of hook and loop material disposable on the bottom surface of the foot pedal assembly; and, said other of hook and loop material including an adhesive for connection to the bottom surface of the foot pedal assembly.

2. Apparatus for preventing a foot pedal assembly from moving away from a seat, comprising:

a mat having a top surface and an opposite bottom surface, said mat shaped and dimensioned to receive the foot pedal assembly and to receive the seat;

one of hook and loop material disposed on said top surface of said mat, said one of hook and loop material positioned, shaped, and dimensioned to removably connect to the foot pedal assembly;

said mat including a seat area in which the seat is positionable, said seat area having a center; and, said one of hook and loop material including a strip, said strip oriented substantially perpendicular to a radial line which outwardly emanates from said center.

3. The apparatus according to claim 2, further including:

a plurality of said strips spaced apart along said radial line, said plurality of strips combining to form a strip sector.

4. The apparatus according to claim 3, the foot pedal assembly having a center line and a bottom surface, the bottom surface including a toe portion which is spaced apart a distance from a heel portion, the apparatus further including:

said plurality of strips including a far strip and a near strip; and, said far strip spaced apart from said near strip by a strip distance such that when the foot pedal assembly is placed upon said mat with the center line oriented along said radial line, the toe portion of the foot pedal assembly will abut said far strip and the heel portion of the foot pedal assembly will abut said near strip.

5. The apparatus according to claim 4, further including:

said plurality of strips including a middle strip which is disposed between said far strip and said near strip.

6. The apparatus according to claim 3, further including:

a plurality of said strip sectors residing in abutting side-by-side relationship.

7. Apparatus for preventing a foot pedal assembly from moving away from a seat, the seat including a plurality of legs each leg having a foot, the apparatus further including:

a mat having a top surface and an opposite bottom surface, said mat shaped and dimensioned to receive the foot pedal assembly and to receive the seat;

one of hook and loop material disposed on said top surface of said mat, said one of hook and loop material positioned, shaped, and dimensioned to removably connect to the foot pedal assembly;

at least one foot anchor station disposed on said top surface of said mat, said foot anchor station including one of hook and loop material; and, at least one foot anchor, said foot anchor shaped and dimensioned to receive one foot of the seat, said foot anchor including the other of hook and loop material so that said foot anchor can be removably connected to said foot anchor station.

8. Apparatus for preventing a foot pedal assembly from moving away from a seat, the foot pedal assembly having a bottom surface, the foot pedal assembly having a center line, the bottom surface including a toe portion which is spaced apart a distance from a heel portion, the apparatus comprising:

a mat having a top surface and an opposite bottom surface, said mat shaped and dimensioned to receive the foot pedal assembly and to receive the seat;

one of hook and loop material disposed on said top surface of said mat, said one of hook and loop material positioned, shaped, and dimensioned to removably connect to the foot pedal assembly;

the other of hook and loop material disposable on the bottom surface of the foot pedal assembly;

said other of hook and loop material including an adhesive for connection to the bottom surface of the foot pedal assembly;

said mat including a seat area in which the seat is positionable, said seat area having a center;

said one of hook and loop material including a strip, said strip oriented substantially perpendicular to a radial line which outwardly emanates from said center;

a plurality of said strips spaced apart along said radial line, said plurality of strips combining to form a strip sector;

said plurality of strips including a far strip and a near strip;

said far strip spaced apart from said near strip by a strip distance such that when the foot pedal assembly is placed upon said mat with the center line oriented along said radial line, the toe portion of the foot pedal assembly will abut said far strip and the heel portion of the foot pedal assembly will abut said near strip;

said plurality of strips including a middle strip which is disposed between said far strip and said near strip; and, a plurality of said strip sectors residing in abutting side-by-side relationship.

9. A method for preventing a foot pedal assembly from moving away from a seat, comprising:

(a) providing a foot pedal assembly having a bottom surface;

(b) providing a seat;

(c) providing apparatus for preventing said foot pedal assembly from moving away from said seat, including:

a mat having a top surface and an opposite bottom surface, said mat shaped and dimensioned to receive said foot pedal assembly and to receive said seat;

one of hook and loop material disposed on said top surface of said mat, said one of hook and loop material positioned, shaped, and dimensioned to removably connect to said foot pedal assembly;

said mat including a seat area in which said seat is positionable, said seat area having a center;

said one of hook and loop material including a strip, said strip oriented substantially perpendicular to a radial line which outwardly emanates from said center;

(d) placing said seat upon said mat so that said seat resides in said seat area;

(e) providing the other of hook and loop material;

(f) connecting said other of hook and loop material to said bottom surface of said foot pedal assembly; and, (g) placing said foot pedal assembly on said strip, so that said foot pedal assembly is connected to said mat.

10. The method of claim 9, further including:

in (a), said foot pedal assembly having a center line, said bottom surface including a toe portion which is spaced apart a distance from a heel portion; and, in (c) providing a plurality of said strips spaced apart along said radial line, said plurality of strips combining to form a strip sector, said plurality of strips including a far strip and a near strip, said far strip spaced apart from said near strip by a strip distance such that in (g) when said foot pedal assembly is placed upon said mat with said center line oriented along said radial line, said toe portion of said foot pedal assembly will abut said far strip and said heel portion of said foot pedal assembly will abut said near strip.

11. The method of claim 9, further including:

in (b), said seat including a plurality of legs each leg having a foot;

in (c), providing at least one foot anchor station disposed on said top surface of said mat, said foot anchor station including one of hook and loop material;

in (c), providing at least one foot anchor, said foot anchor shaped and dimensioned to receive one foot of said seat, said foot anchor including the other of hook and loop material so that said foot anchor can be removably connected to said foot anchor station;

connecting said foot anchor to said foot anchor station; and, positioning said foot in said foot anchor for the purpose of keeping said mat from moving.

* * * * *